United States Patent [19]

Serwatowski

[11] 4,403,535

[45] Sep. 13, 1983

[54] VEHICLE TRANSPORTABLE CORDWOOD CUTTING MACHINE

[76] Inventor: Frank J. Serwatowski, 12155 Spencer Rd., Milford, Mich. 48042

[21] Appl. No.: 222,157

[22] Filed: Jan. 2, 1981

Related U.S. Application Data

[63] Continuation-in-part of Ser. No. 39,205, May 15, 1979, abandoned.

[51] Int. Cl.[3] ..... B27B 5/10

[52] U.S. Cl. ..... 83/490; 83/733; 83/928

[58] Field of Search ..... 83/490, 733, 928

[56] References Cited

U.S. PATENT DOCUMENTS 1,409,741 3/1922 Lindemon ..... 83/733
1,520,955 12/1924 Koeber ..... 83/733

FOREIGN PATENT DOCUMENTS 476810 9/1951 Canada ..... 83/733
955245 6/1949 France ..... 83/928

*Primary Examiner*—Donald R. Schran

*Attorney, Agent, or Firm*—James M. Deimen

[57] ABSTRACT

The invention comprises an improved cordwood cutting saw accessory for small garden tractors. The saw frame is proportioned and constructed to provide a safely operable saw attachment without the need for auxiliary stabilizing supports and level ground upon which to park the tractor and operate the saw.

The saw frame is cantilevered from the front of the garden tractor the minimum horizontal distance necessary to support a circular saw blade and shaft adjacent the top of the tractor cowl. The elevation of the saw is substantially between the waist and shoulders of the saw user. The vertical height of the saw frame is equal or greater than the horizontal cantilevered length of the saw frame and two or more times the height from the ground of the cantilevered attachment to the tractor.

The accessory thereby does not seriously disturb the stability of a light small garden tractor despite the capability of cutting cordwood logs of any size that can be conveniently lifted and placed on the saw table or feeder by a single operator.

14 Claims, 6 Drawing Figures

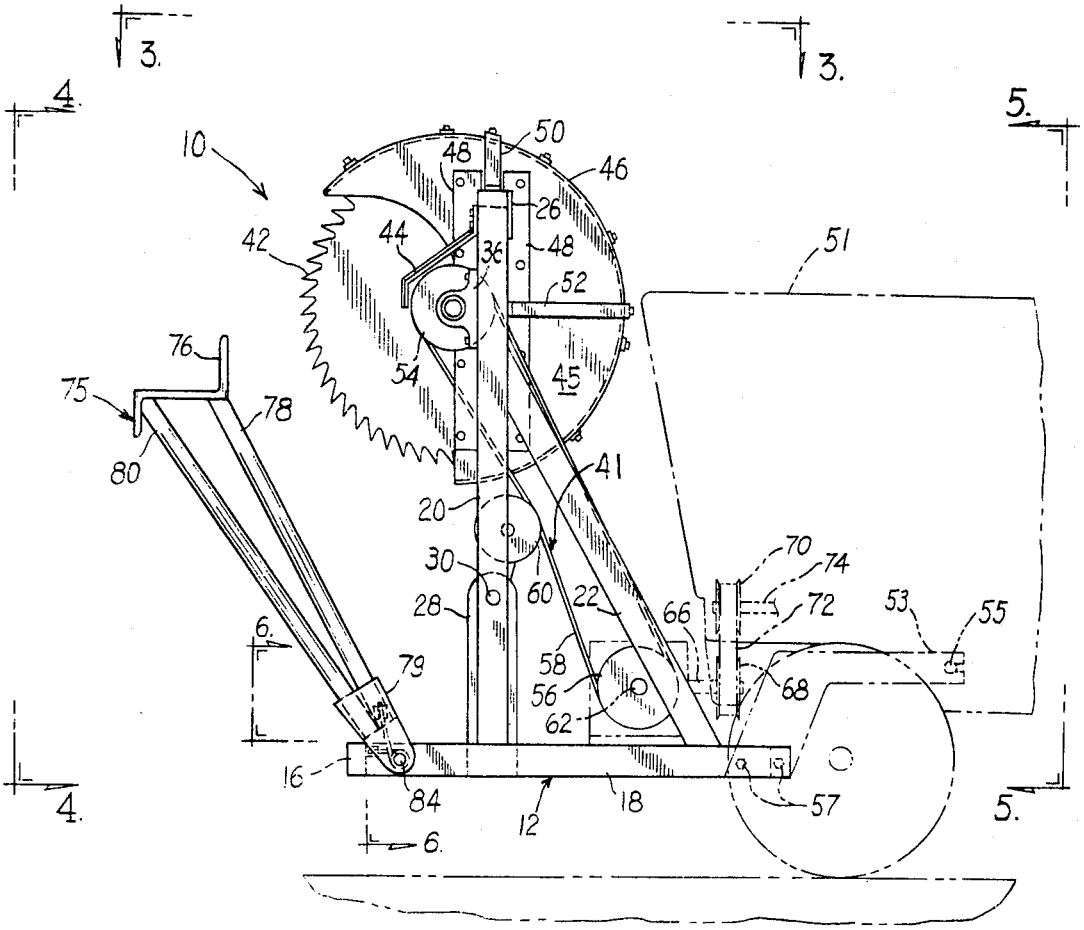
FIG. 1
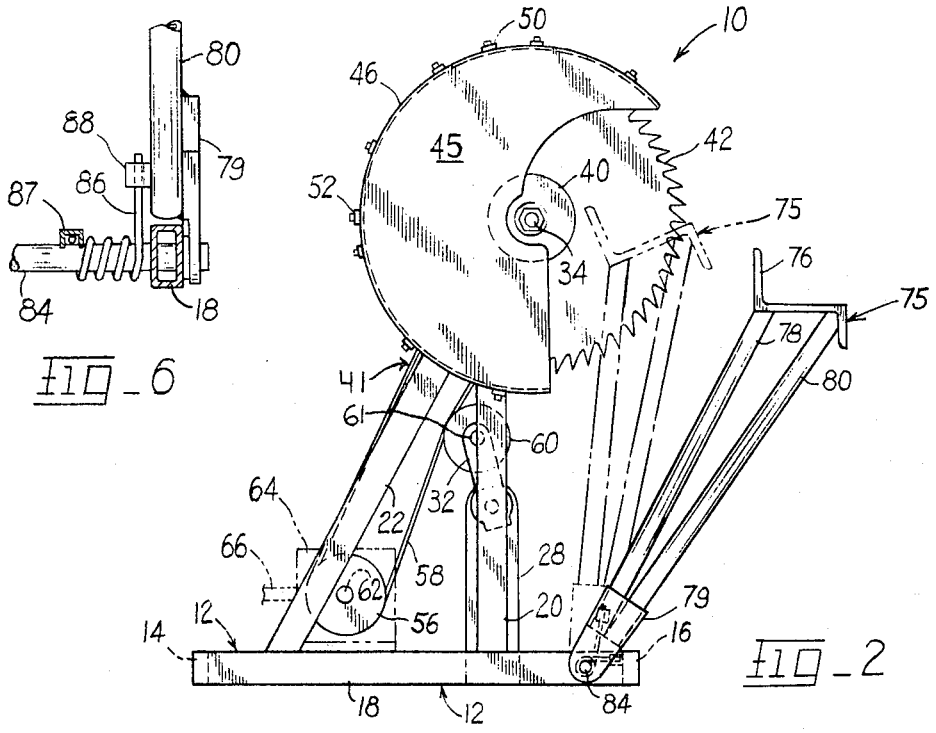
FIG. 6
FIG. 2

VEHICLE TRANSPORTABLE CORDWOOD CUTTING MACHINE

BACKGROUND OF THE INVENTION

This application is a continuation-in-part of application Ser. No. 39,205, filed May 15, 1979, to be abandoned upon the filing of this application.

The field of the invention pertains to wood cutting and in particular to the cutting of logs into cordwood for use in fireplaces and wood burning stoves for home use.

A wide variety of saws including chain saws, hand saws and circular blade saws have been used for years to cut cordwood. With the advent of farm tractors cordwood cutting saw accessories were developed to provide farmers with a convenient means of cutting timber from farm wood lots into convenient sized logs for the farm woodstove. U.S. Pat. Nos. 1,837,141, 2,350,880 and 2,536,910 illustrate farm tractor mounted cordwood cutting saws, one a front mounted saw and the others rear mounted saws. Two of the saws require reasonably level ground upon which to rest legs of the saw after the saw is brought on the tractor to the wood cutting location. The saws disclose tables or platforms upon which to rest the cordwood and feed it into the saw, U.S. Pat. No. 933,965 illustrates such a table for feeding cordwood into the saw.

To eliminate the need for level ground and the time required for set up, front mounted cantilevered saws for large farm tractors were developed as illustrated by the U.S. Pat. Nos. 1,464,878, 1,520,955 and 2,269,348. Because of the cantilevered mounting with a relatively long lever arm in front of the small front tractor wheels, a large and heavy farm tractor is required to prevent the saw from tilting over onto the operator as he cuts cordwood. The saw table or feeder is between waist and shoulder height for convenience and safety. These cantilevered saws therefore have relatively long horizontal frames in comparison to the height of the cutting blade shaft above the horizontal frame. In some cases the cutting blade shaft is mounted directly onto the horizontal frame.

In recent years the small garden tractor has become very popular with many attachments available as optional equipment. The saws illustrated above however, are completely unsuitable as attachments to small garden tractors. As shown they are much to large and unwieldy to be attached to a garden tractor and would cause the garden tractor to be unstable and unsafe if so attached. If the above saws were constructed to a smaller scale, the blade and saw table would be much to low to the ground to be safely and conveniently operated. Such a saw would have insufficient capacity to handle all sizes of cordwood.

The garden tractor mounted saw disclosed in this application was developed to overcome the shortcomings noted above and to provide a very safe and convenient garden tractor mounted cordwood cutting saw that can be utilized by the typical owner of a garden tractor.

SUMMARY OF THE INVENTION

The invention comprises a cordwood cutting saw accessory for small garden tractors. The saw is proportioned and constructed to be safely operable on the tractor without the need for auxiliary stabilizing supports and level ground upon which to park the tractor when operating the saw. The horizontal frame of the saw is cantilevered beyond the front of the garden tractor the minimum length necessary to support a vertical frame of sufficient height to position the saw blade and saw table vertically between the waist and shoulders of the operator of the saw. The saw feeder or table support extends generally diagonally upwardly from the saw frame to also minimize the horizontal cantilevered length of the frame. The vertical height of the saw frame is equal or greater than the horizontal cantilevered length of the saw frame and the saw blade shaft is adjacent the top of the garden tractor cowl. The proportions of the saw frame minimize the size and cantilevered weight of the saw accessory thereby retaining the stability of the garden tractor and providing a cordwood saw that can be safely operated without fear of toppling over the saw and tractor.

Other advantages of the applicant's cordwood saw are apparent from the following description taken in conjunction with the accompanying drawings.

DESCRIPTION OF THE DRAWINGS

FIG. 1 is a left side elevational view of the saw including the ghosted outline of the front of a small garden tractor;

FIG. 2 is a right side elevational view of the saw;

FIG. 6 is a fragmentary vertical sectional view taken along the line 6—6 in FIG. 1.

DESCRIPTION OF THE PREFERRED EMBODIMENT

Figure 3:
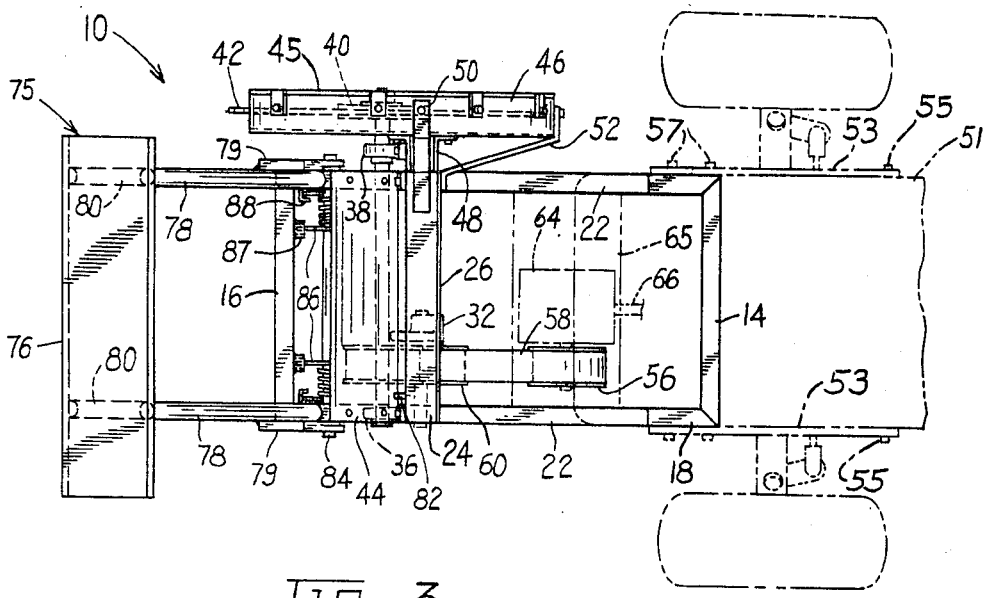
FIG. 3 is a top view of the saw including the ghosted outline of a small garden tractor.

Referring to FIGS. 1 through 5, 10 generally designates the vehicle transportable cordwood cutting machine comprising a frame 12 consisting of frame members 14, 16 and 18 which form a horizontal portion thereof and frame members 20 and 22 which form an upright portion thereof. Frame members 24 and 26 join the upper ends of the upright frame members 20. The upright portion is disposed rearwardly of the front end of the horizontal frame portion. The upright portion rotatably supports at approximately shoulder height a horizontal shaft 34 to one end of which is affixed a circular saw 42. The rear end of the frame 12 is joined to the front end of a small garden tractor 51 as shown in FIGS. 1 and 3 by conventional garden tractor attachment means 53, 55 and 57. The entire machine 10 is supported by the garden tractor for transport to the source of cordwood, such as a forest area. The saw 42 is rotatably driven from the power take-off (PTO) shaft 74 of the tractor 51 via a power train, generally designated 41, and consisting of the shaft 34, an endless belt 58, pulleys 54, 56 and 60, shafts 30, 61, 62 and 66, support member 32 and gear box 64.

A master PTO control switch 82 is conveniently mounted on the front of the upright frame portion so as to be conveniently accessible to the machine operator. The switch 82 actuates an electromagnetic clutch in the pulley 56 to engage the pulley 56 with the shaft 62 and thereby drive the saw 42. The saw 42 is guarded as shown by a housing 45, 46 connected to one of the upright frame members 20 by angle iron members 48 and braces 50 and 52.

Figure 4:
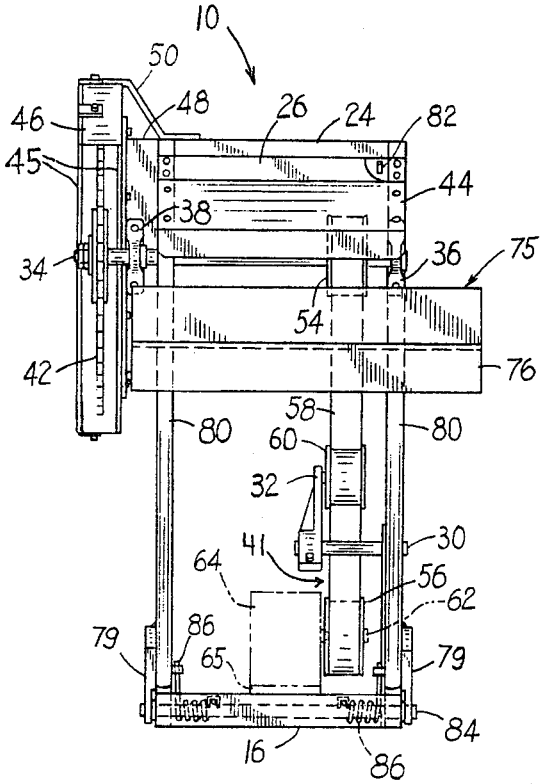
FIG. 4 is a front view of the saw.
Figure 5:
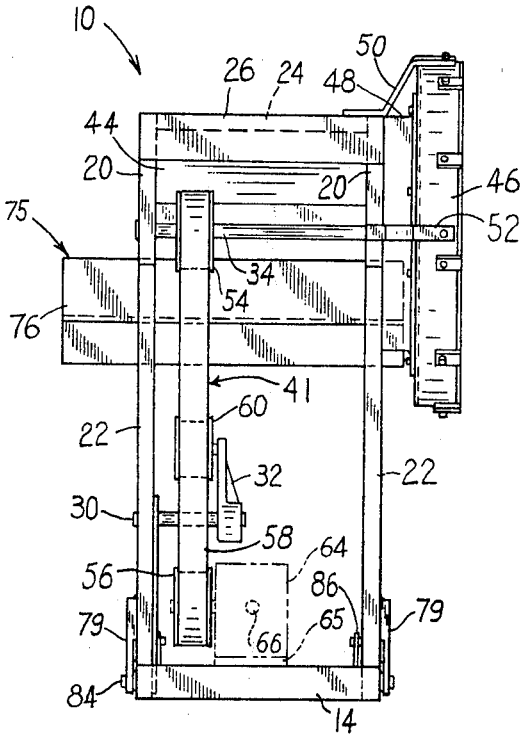
FIG. 5 is a rear view of the saw.

An upstanding saw table 75 consisting of a cordwood holding shelf 76 and diagonal supports 78 and 80 is pivotably mounted on the front end of the frame 12 by a pair of plates 79 pivotably connected to a shaft 84 held fast between frame members 18. The shelf 76 is formed into a deck, rear wall and front skirt standing at approximately shoulder height as shown and extends widthwise of and beyond the frame 12 on one side of the machine 10. Referring to FIGS. 4 and 6, the saw table 75 is normally biased into an at-rest position furtherest from the saw 42 by a pair of tension springs 86 held by spring catches 87 and 88 and wrapped about the shaft 84 at opposite ends thereof. When pushed upon, the saw table 75 is capable of moving rearwardly of the saw 42 as shown by broken lines in FIG. 2 so as to cut cordwood laid thereon. The facility and speed of such cutting is enhanced by the large ratio of diameter of saw blade 42 to the diameter of cordwood to be cut, said ratio being of the order of at least 3 to 1.

Referring to FIG. 1 the saw blade shaft 34 is seen to be at approximately the height of the garden tractor cowl shown ghosted at 51. As shown the vertical frame members 20 and 22 support the shaft 34 at an elevation above the horizontal frame members 18 substantially equal to the length of the frame members 18 and in excess of the horizontal cantilevered distance of the vertical members 20 and 22 from the attachment to the tractor at 57. The horizontal frame members 18 are mounted low to the ground, substantially level with the front axle of the garden tractor and less than one third the elevation of the shaft 34 from the ground. This frame configuration minimizes the effect of the weight of the machine on the stability of a small garden tractor despite the cantilevered attachment to the tractor. The saw table 75 and saw 42 are approximately waist to shoulder high for operator safety and convenience. On some models of garden tractors the shaft 34 and saw table 75 will be substantially above the top of the tractor cowl.

To operate the machine 10, the user drives the garden tractor into a forest area directly to the cordwood supply. When the user is ready to cut cordwood, he energizes the tractor motor and depresses the tractor PTO switch (not shown) to engage the tractor PTO shaft 74. He then depresses the master PTO switch 82 to rotatable drive the saw 42. The power of the tractor PTO shaft 74 is taken off by the pulley and belt arragement 68, 70 and 72 and shafts 62 and 66 and gear box 64 to the drive pulley and electromagnetic clutch 56. Power from the drive pulley 56 is transmitted to the shaft 34 by the pulley and belt arrangement 54, 56 and 58. The pulley 60 is angularly positionable for belt tightening purposes by adjustment of the angular position of the member 32 on the shaft 30. Each length of cordwood to be cut is placed upon the shelf 76 and held against the back wall thereof in a widthwise position relative to frame 12 so that it will be cut to the desired length. The user then pushes upon the cordwood to move it against the rotating saw 42 to cut the same through. For the next cut the length of cordwood is slid lengthwise on said table 76 in front of the saw 42 to a new position to cut the next length of cordwood. The cordwood can be held with the user's two hands so that even long lengths of cordwood can be be easily held on the saw table 75 by the operator.

It will thus be seen that there has been provided by my invention a vehicle transportable cordwood cutting machine in which the object hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

I claim:

1. A vehicle transportable cordwood cutting machine attachable to a vehicle so as to be transportable in operable mode, said vehicle having a frame, said machine comprising at least two horizontal frame members, means at one end of each of said two horizontal frame members for cantilevered attachment to said vehicle frame, said horizontal frame members thereby extending outwardly from said vehicle frame, at least two vertical frame members extending upwardly from and joined to said horizontal frame members, each of said vertical frame members at a position spaced from said cantilevered attachment, the height of said vertical frame members above said horizontal frame members being at least twice the elevation of the horizontal frame members above the ground upon which the vehicle is supported, wood cutting means supported on said vertical frame members adjacent the top thereof, means including a power train for powering said wood cutting means, a pair of support members pivotably mounted on one end of said horizontal frame members, a saw table made fast to the upper ends of said pivotable support members constructed to hold a length of cordwood thereon widthwise of said frame members, means yieldably biasing said saw table into an at-rest position disposed away from said wood cutting means, said saw table capable of moving past said wood cutting means when the user pushes against a length of cordwood held on said saw table so as to cut the same into the desired length.

2. A vehicle transportable cordwood cutting machine as claimed in claim 1, said cutting means including a horizontal shaft rotatably supported adjacent the upper end of said vertical frame members, said power train rotatably driving said shaft, said wood cutting means including a saw blade connected to said shaft so as to be powered thereby.

3. A vehicle transportable cordwood cutting machine as claimed in claim 2, said saw blade being circular, the ratio of the diameter of said circular saw blade to the diameter of cordwood to be cut being on the order of at least 3 to 1.

4. A vehicle transportable cordwood cutting machine as claimed in claim 2, said saw blade supported on said vertical frame members at substantially waist to shoulder height and said saw table supported on said horizontal frame members at substantially waist to shoulder height.

5. A tractor transportable cordwood cutting machine comprising a substantially horizontal frame, means for cantilevered attachment of one end of the horizontal frame to the front end of the frame of a small tractor below the cowl thereof, a second frame attached to and extending generally upwardly from the horizontal frame at a position spaced from the cantilevered attachment, wood cutting means mounted on the upper portion of the second frame a distance above the horizontal frame at least equal to the length of the horizontal frame, means adapated to provide power to the wood cutting means and means adapted to support and move cordwood into contact with the wood cutting means, said machine transportable in operable mode entirely supported by the cantilevered attachment to a tractor.

6. The tractor transportable cordwood cutting machine of claim 5 wherein the support means are pivotally attached to the machine and include means to bias the support means away from the wood cutting means.

7. The tractor transportable cordwood cutting machine of claim 6 wherein the pivotable support means includes a table pivoting substantially toward the mounting of the wood cutting means.

8. The tractor transportable cordwood cutting machine of claim 5 wherein the vertical elevation of the mounting of the wood cutting means is at substantially waist to shoulder height.

9. The tractor transportable cordwood cutting machine of claim 5 wherein the cantilevered attachment is located beneath the frame of the tractor and the horizontal frame is substantially level with the tractor front axle.

10. A vehicle transportable cordwood cutting machine comprising a substantially horizontal frame, means at one end of said horizontal frame for cantilevered attachment to the frame of a vehicle, said horizontal frame extending outwardly from the vehicle, an upwardly extending second frame attached to the horizontal frame at a position spaced from the cantilevered attachment, wood cutting means mounted on said second frame a distance above the horizontal frame greater than twice the elevation of the horizontal frame above the ground upon which the vehicle is supported, means adapted to provide power to the wood cutting means, and means adapated to support and move cordwood into contact with the wood cutting means, said machine transportable in operable mode entirely supported by the cantilevered attachment.

11. The vehicle transportable cordwood cutting machine of claim 10 wherein the support means are pivotally attached to the machine and include means to bias the support means away from the wood cutting means.

12. The vehicle transportable cordwood cutting machine of claim 11 wherein the pivotable support means includes a table pivoting substantially toward the mounting of the wood cutting means.

13. The vehicle transportable cordwood cutting machine of claim 10 wherein the vertical elevation of the mounting of the wood cutting means is at substantially shoulder height.

14. The vehicle transportable cordwood cutting machine of claim 10 wherein the cantilevered attachment is located beneath the frame of a small tractor.

* * * * *